US007181949B2

(12) United States Patent
Haberkamm et al.

(10) Patent No.: US 7,181,949 B2
(45) Date of Patent: Feb. 27, 2007

(54) STRIP-EDGE-BASED DISPLACEMENT OF INTERMEDIATE ROLLS IN SIX-HIGH ROLLING STAND

(75) Inventors: Klaus-Dieter Haberkamm, Siegen (DE); Andreas Ritter, Haiger (DE); Rüdiger Holz, Neunkirchen (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 256 days.

(21) Appl. No.: 10/343,305

(22) PCT Filed: Jul. 11, 2001

(86) PCT No.: PCT/EP01/07998

§ 371 (c)(1),
(2), (4) Date: Apr. 11, 2003

(87) PCT Pub. No.: WO02/09896

PCT Pub. Date: Feb. 7, 2002

(65) Prior Publication Data

US 2003/0164020 A1 Sep. 4, 2003

(30) Foreign Application Priority Data

Jul. 29, 2000 (DE) ..... 100 37 004

(51) Int. Cl.
*B21B 29/00* (2006.01)

(52) U.S. Cl. ..... 72/243.6; 72/247

(58) Field of Classification Search ..... 72/241.2, 72/243.6, 237, 247

See application file for complete search history.

(56) References Cited

U.S. PATENT DOCUMENTS 3,733,878 A * 5/1973 Anderson et al. ..... 72/243.6
3,943,742 A * 3/1976 Kajiwara et al. ..... 72/247
4,537,057 A * 8/1985 Kajiwara et al. ..... 72/241.4

FOREIGN PATENT DOCUMENTS

| | | |
|---|---|---|
| DE | 198 11 633 | 9/1999 |
| EP | 0 026 903 | 4/1981 |
| EP | 0 258 482 | 3/1988 |
| JP | 59056905 | 4/1984 |
| JP | 11057821 | 3/1999 |

OTHER PUBLICATIONS

Multipurpose, High Performance Fully Continuous Tandem Mill (8297 Hitachi Review 42(1993) Aug. No. 4.

* cited by examiner

*Primary Examiner*—Lowell A. Larson
(74) *Attorney, Agent, or Firm*—Andrew Wilford

(57) ABSTRACT

A method for the strip-edge-oriented shifting of the intermediate rolls (11, 11') in a six-roll rolling mill comprising respectively a pair of workrolls (10, 10'), intermediate rolls (11, 11') and backup rolls (12, 12'), whereby at least the intermediate rolls (11, 11') and workrolls (10, 10') have devices for axial shifting cooperating with them and each intermediate roll (11, 11') has a barrel elongated by the amount of the CVC-shifting stroke and a one sided setback (x) in the region of the strip edge. The method is characterized in that the upper intermediate roll (11) is shifted in the direction of the drive side AS) and the lower intermediate roll (11') is shifted in the direction of the service side (BS)—or conversely—relative to the neutral shift position ($S_{zw}$=0 mm) symmetrically to the rolling mill center (y—y) be respectively the same amount in the direction of their (x—x).

2 Claims, 3 Drawing Sheets

STRIP-EDGE-BASED DISPLACEMENT OF INTERMEDIATE ROLLS IN SIX-HIGH ROLLING STAND

CROSS REFERENCE TO RELATED APPLICATIONS

This application is a national stage of PCT/EP 01/07998 filed 11 Jul. 2001 and based upon German National application 100 37 004.7 filed 29 Jul. 2000 under the International Convention.

FIELD OF THE INVENTION

The invention relates to a method of and an apparatus for the strip-edge-oriented shifting of the intermediate rolls in a six-roll rolling mill, comprising respectively a pair of work rolls, a pair of intermediate rolls and a pair of back-up rolls, whereby at least the intermediate and work rolls cooperate with devices for axially shifting them and each intermediate roll has a barrel elongated by the CVC (continuous variable crown) shifting stroke with a one-sided setback or ground-back region in the region of the strip edge.

BACKGROUND OF THE INVENTION

The quality requirements of cold-rolled strip with respect to thickness tolerances, the attainability of certain final thicknesses, strip profiles or cross sections, strip planarities, etc. are continuously increasing in the course of developments. As a consequence of such developments, the requirements for flexible rolling mill concepts and modes of operation are likewise increasing and are required to be optimally matched to an end product to be rolled.

For the classical rolling mill types referred to as quarto or four-high mills and six-high or sexto mills there are aside from basic concepts with bending systems and fixed roll barrel shapes as roll gap influencing elements, two significant further rolling mill concepts which additionally affect the rolling gap by shifting of the working rolls or intermediate rolls based upon different effective principles. These are:

CVC/CVC-plus Technology and

The technology of strip-edge-oriented shifting of rolls.

Up to now both of these technologies have required different rolling mill concepts because different roll geometries were required for them.

In the classic CVC or continuous variable crown technology, the barrel-shaped lengths or contour lengths of the shiftable rolls was always longer than those of the fixed unshift-able rolls by the axial shifting stroke. The shiftable rolls thus need not have had their barrel terminating edge shifted beneath the stationary roll barrel. Thus surface damage or marking is avoided.

By contrast in the technology of strip-edge-oriented shifting, in the entire set of rolls, rolls with identical barrel or contour lengths are used. The shiftable rolls are thus shaped at the one side in the barrel edge region with a corresponding geometry, especially they can be provided with a taper. As a result, locally arising load peaks can be reduced.

The effective principle depends upon the strip-edge-oriented readjustment of the barrel edge, either ahead of, or at, or even behind the strip edge. Especially in the case of six-roll rolling mills, the shifting of the intermediate rolls beneath the backing roll gives rise to a targeted influence on the effectiveness of the positive work roll bending.

OBJECT OF THE INVENTION

The invention has as its object to utilize both technologies through a unitary mode of operation in a rolling mill conceptualization with geometrically identical roll sets.

SUMMARY OF THE INVENTION

To achieve this object, a method for the strip-edge-oriented shifting of the intermediate roll in a six-roll rolling mill is provided in accordance with the invention in which the upper intermediate roll is shifted in the direction of the drive side AS) and the lower intermediate roll is shifted in the direction of the service side (BS)—or conversely—relative to the neutral shifting position ($S_{zw}$=0 mm)), symmetrically with respect to the middle of the rolling mill by respectively the same amounts in the direction of their axes.

By the use of intermediate rolls with filled setbacks or ground-back regions and strip-width dependent optimization of the axial shifting positions, the effectiveness of the positive work roll bending can be influenced in a targeted manner. Thus the roll gap can be optimally set.

In a refinement of the process, through the shifting of each intermediate roll, the beginning of the recess is positioned externally of, or at, or within the strip edge, i.e. within the strip width.

And finally, the method provides that the shifted positions in different strip width regions are given piecemeal (piece-by-piece) by linear expressions or functions which relate different positions of the beginning of the start to the strip edge.

An intermediate roll for strip-edge-oriented shifting with two-sided elongated roll barrels or contours on the two sides, especially for carrying out the method according to the invention is characterized in that they each have elongated barrels extended by the CVC stroke which are symmetrical with respect to the neutral shift position ($S_{zw}$=0 mm) at the rolling mill center.

As a basis for the rolling mill concept with intermediate rolls for strip-edge-oriented shifting with two-sidedly elongated roll barrel, the roll configuration from CVC/CVC-plus-technology for a six-roll rolling mill is used.

As a refinement of the intermediate roll for strip-edge-oriented shifting with two sides elongated rolling contours provides that the barrel at the service side (BS) is provided with the setback (x) or ground back region, whose length (l) is subdivided into two adjoining regions a and b as to which the following equations apply:

| | | |
|---|---|---|
| Region a: | $x = \sqrt{R^2 - (R - d)^2}$ | $y(x) = R - \sqrt{R^2 - (1 - x)^2}$ |
| Region b: | $x = 1 - a$ | $y(x) = d = \text{const.}$ |

R is the radius of curvature.

As a result locally arising load peaks are reduced, as is based upon the effective principle of the strip-edge-oriented reshifting of the barrel edge, either ahead of or to or to a location behind the strip edge. Especially in the case of six-roll rolling mills, the shifting of the intermediate rolls beneath the backing rolls gives rise to a targeted influence on the effectiveness of positive work roll bending.

An intermediate roll is further characterized in that the transition between the recess (x) between the regions a or b, for example for a given length a of 100 mm is effected with a sequential setback of the measurement d in accordance with the following table:

Over a:

| x | |
|---|---|
| 10 | d/512 |
| 20 | d/256 |
| 30 | d/128 |
| 40 | d/64 |
| 50 | d/32 |
| 60 | d/16 |
| 70 | d/8 |
| 80 | d/4 |
| 90 | d/2 |
| 100 | d |

And finally, a refinement of the rolling mill in accordance with the invention provides that the one-sided setback (x) is provided on the upper intermediate roll, preferably at the service side (BS) and on the lower intermediate roll at the drive side (AS) or inversely.

BRIEF DESCRIPTION OF THE DRAWING

Details, features and advantages of the invention are given in the following description of several embodiments schematically illustrated in the drawing.

In the drawing.

SPECIFIC DESCRIPTION

Figure 1:
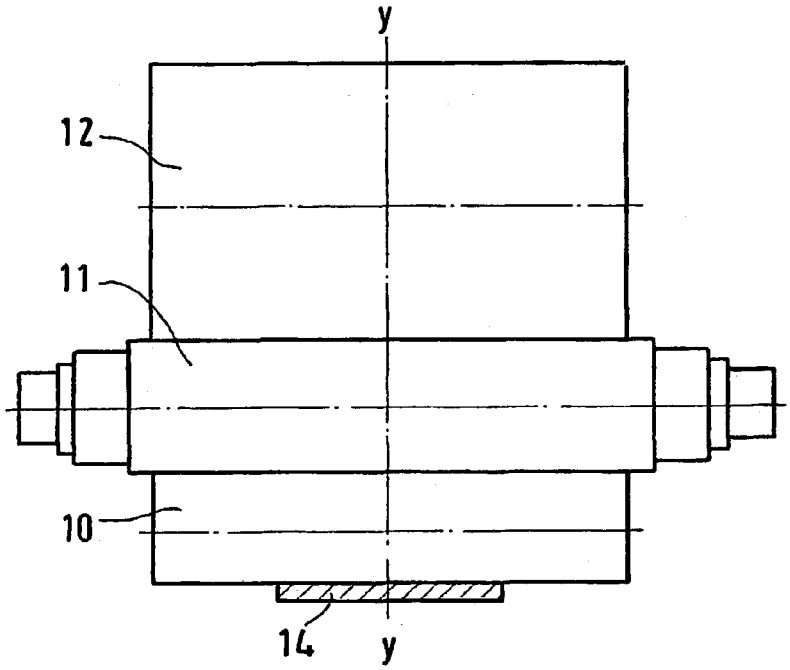
FIG. 1 is a diagrammatic elevation of one half of a six-high mill showing a geometry of the intermediate roll without the roll setback or ground-away region.

The intermediate roll shown in FIG. 1 is derived from the roll configuration of the CVC/CVC-plus-technology for a six-high rolling mill. FIG. 1 shows a work roll 10, an intermediate roll 11 and a backup roll 12. The shiftable intermediate roll has a barrel extended in length relative to the other rolls by the amount of the CVC shifting stroke which has a neutral shifting position at the /center of the rolling mill defined by the plane y—y.

Figure 2:
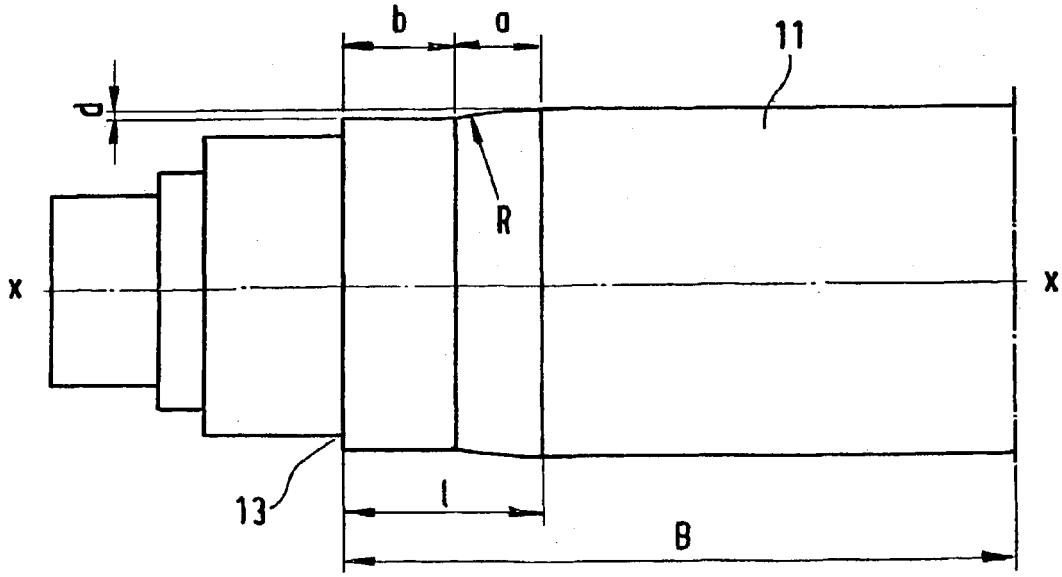
FIG. 2 is an elevational view of part of an intermediate roll showing a one-sided setback or ground-away region in the region of the barrel edge of the intermediate roll.

FIG. 2 shows a one-sided ground-away region or setback x in the region of the barrel edge 13 of the intermediate roll 11. The setback x has the length l and the barrel of the intermediate roll 11 extends from the barrel edge 13 up to the barrel center with the length B. The length of the setback x is divided into two adjoining segments. In the first segment a, the setback conforms to the circle equation $$(1-x)^2+y^2=R^2$$

If a predetermined minimal required diameter reduction 2*d*, dependent upon the external boundary conditions, for example, rolling force and the thereby resulting roll deformation, is reached, the setback x will run linearly up to the barrel edge 13. The diameter reduction is thus so provided that the work roll can bend freely by the amount of the setback x of the intermediate roll without a contact therewith in region b. The length l of the setback is subdivided into the regions a and b which can be calculated from the equations.

The transition between region a and region b can be made with or without a continuous transition.

With another transition function for a predetermined length a of 100 mm, a special setback of the dimension d resulting from the ablation or grinding away can be effected according to the following table:

Over a:

| x | |
|---|---|
| 10 | d/512 |
| 20 | d/256 |
| 30 | d/128 |
| 40 | d/64 |
| 50 | d/32 |
| 60 | d/16 |
| 70 | d/8 |
| 80 | d/4 |
| 90 | d/2 |
| 100 | d. |

The predetermined function here is flatter in the transition region than a radius and is very much steeper at the ends. Because of reasons of grinding technology, the transition toward the cylindrical part is made with a correspondingly greater break in the transition between a and b (about 2×d).

Figure 3:
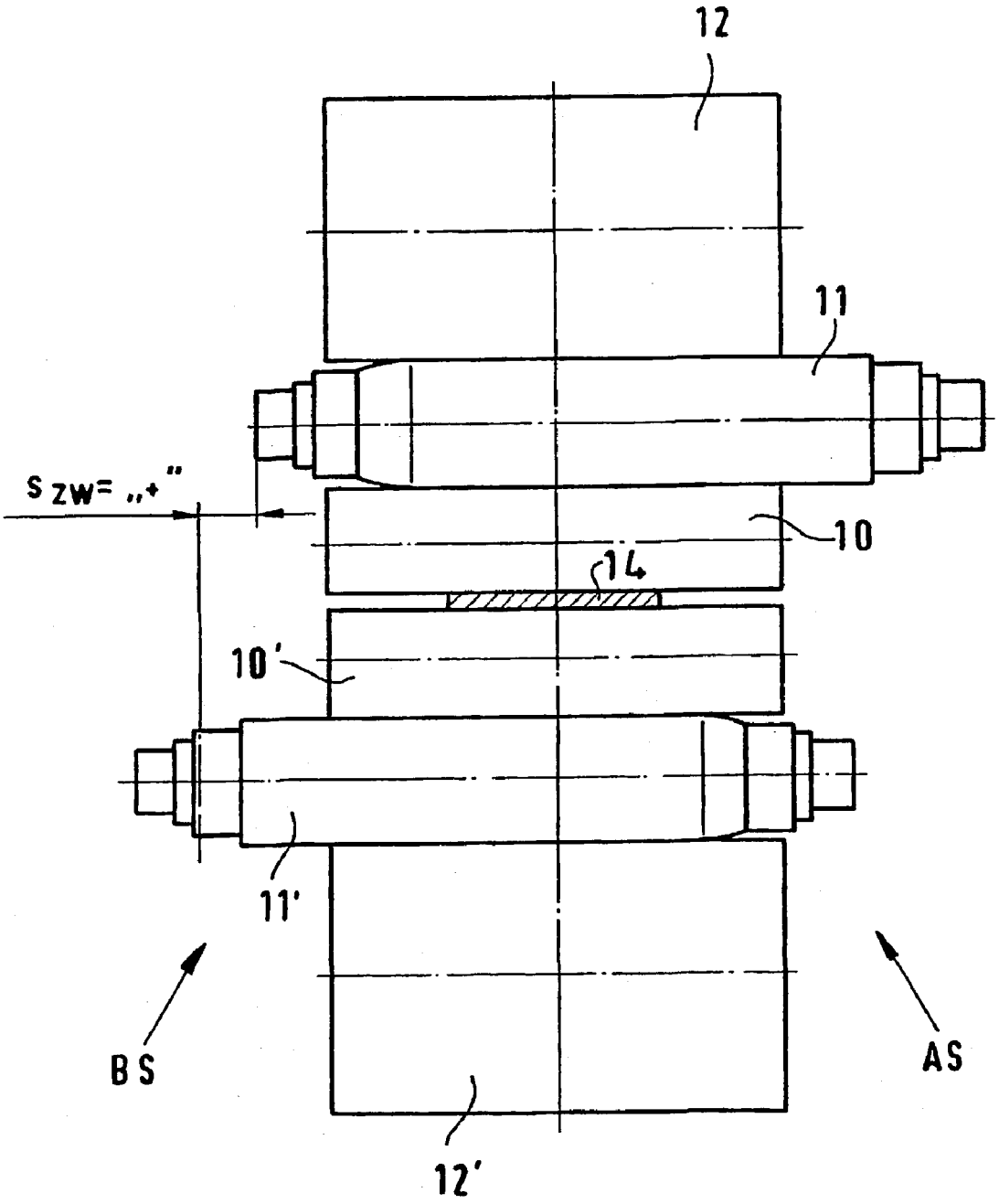
FIG. 3 is an elevational view of a six-high mill for strip-edge-oriented shifting with elongated intermediate roll barrels.

As can be seen from FIG. 3, in the normal case, the one-sided setback is provided on the upper intermediate roll 11 at the service side BS and on the lower intermediate roll 11' at the drive side AS, although it, however, does not change the effective principle when one applies the setback x of the upper intermediate roll 11 at the drive side AS and on the lower intermediate roll 11' at the service side.

Figure 4:
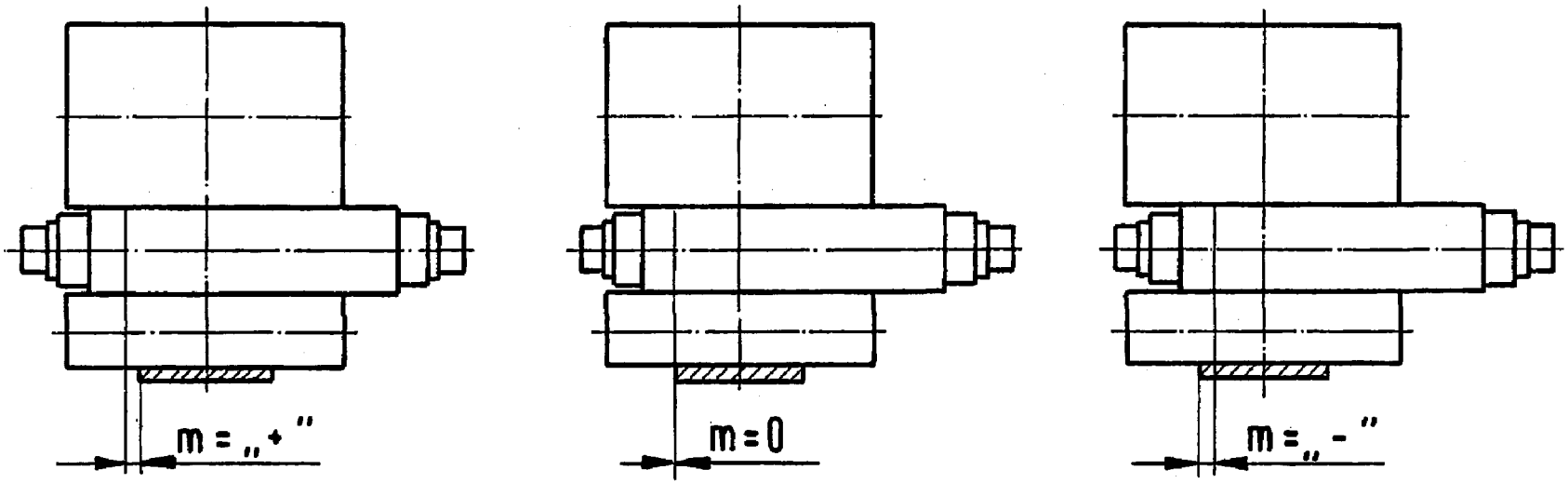
FIG. 4 is an elevational view of a set of different positions of the intermediate roll setback.

By the axial shifting of the intermediate rolls 11, 11', the beginning of the setback x can be positioned outwardly to, at, or inwardly of the strip edges 14, 14' as FIG. 4 shows. This positioning is effected as a function of the strip width and material characteristics can be targeted at effectively setting a positive work roll bending. Positive shifting of the intermediate roll 11 signifies that the upper intermediate roll 11 is shifted in the direction AS and the lower intermediate roll in the direction BS as can be determined from FIG. 3.

FIG. 4 shows positioning of the intermediate roll setback with: Shifting of the intermediate roll outside the strip edge (m="+")

Shifting of the intermediate roll onto the strip edge (m=0)

Shifting of the intermediate roll within the strip edge (m="−")

In different strip width regions, the shift positions is predetermined by piecemeal linear step functions which define definite positions of the beginning of the setback x relative to the strip width.

The most important advantage of the described rolling mill concept, with only one geometrically identical roll set both CVC/CVC-plus-technology of strip-edge-oriented shifting can be obtained. It is no longer necessary to have different roll types. Differences can reside only in the nature of the grinding of the rolls, however for a CVD plus- or setback x in accordance with the above-defined parameters.

The invention claimed is:

1. A rolling mill comprising:

a rolling mill stand having a vertical median plane, a service side on one side of said stand and a drive side on an opposite side of said stand;

a pair of horizontal work rolls in said stand for rolling a workpiece in the form of a metal strip;

a respective intermediate roll bearing upon each of said work rolls;

a respective backing roll bearing upon each of said intermediate rolls, each of said intermediate rolls having a bearing region extended axially beyond the respective work and bearing rolls by an amount equal to a displacement stroke of said intermediate rolls;

one of said intermediate rolls being provided at only one end with a setback region turned toward one of said sides and the other of said intermediate rolls being provided with only one setback region turned toward the other of said sides, each of said setback regions being divided into two mutually adjoining inner and outer regions a and b, the inner region a being curved and forming a flush transition with the respective outer region b, each inner region a having a contraction following the trigonometric equation $(1-x^2)+y^2=R^2$, each outer region b extending from the respective inner region a to the end of the respective bearing region, the inner and outer regions a and b conforming to the equations

| | | |
|---|---|---|
| Region a: | $x = \sqrt{R^2 - (R - d)^2}$ | $y(x) = R - \sqrt{R^2 - (1 - x)^2}$ |
| Region b: | $x = 1 - a$ | $y(x) = d = \text{const},$ |

where x and y are coordinates of points on the surface of the intermediate roll, R is a radius of curvature of the inner region a, 1 is a length of the setback region, and d is an amount of roll diameter reduction.

2. The rolling mill defined in claim 1 wherein a transition of the setback between regions a and b in the case of a predetermined length of 100 mm for a follows a sequential reduction of the dimension d according to the table Over a:

| x | |
|---|---|
| 10 | d/512 |
| 20 | d/256 |
| 30 | d/128 |
| 40 | d/64 |
| 50 | d/32 |
| 60 | d/16 |
| 70 | d/8 |
| 80 | d/4 |
| 90 | d/2 |
| 100 | d. |

* * * * *